United States Patent [19]

Brinker et al.

[11] Patent Number: 4,648,232

[45] Date of Patent: Mar. 10, 1987

[54] APPARATUS FOR CHECKING THE QUALITY OF ROD-SHAPED, CYLINDRICAL OBJECTS

[75] Inventors: Alfred Brinker, Gevelsberg; Iain G. Stewart; Uwe Dreyer, both of Wuppertal, all of Fed. Rep. of Germany

[73] Assignee: Maschinenfabrik Fr. Niepmann GmbH & Co., Gevelsberg, Fed. Rep. of Germany

[21] Appl. No.: 851,123

[22] Filed: Apr. 11, 1986

[30] Foreign Application Priority Data

Apr. 13, 1985 [DE] Fed. Rep. of Germany ..... 3513302
Mar. 19, 1986 [DE] Fed. Rep. of Germany ..... 3609094

[51] Int. Cl.[4] ..... B07C 5/00; B65B 57/14

[52] U.S. Cl. ..... 53/54; 53/151; 209/535

[58] Field of Search ..... 53/54, 444, 494, 498, 53/151, 150, 149, 148; 209/535, 536, 537; 131/282, 283, 907, 908, 905

[56] References Cited

U.S. PATENT DOCUMENTS 3,320,717 5/1967 Molins et al. ..... 53/151
4,174,780 11/1979 Farrar et al. ..... 209/536
4,209,955 7/1980 Seragnoli ..... 53/54
4,487,001 12/1984 Tolasch et al. ..... 53/151
4,489,534 12/1984 Gömann et al. ..... 53/151
4,496,055 1/1985 Green et al. ..... 209/536
4,574,958 3/1986 Manservisi ..... 209/535

*Primary Examiner*—James F. Coan
*Attorney, Agent, or Firm*—Becker & Becker, Inc.

[57] ABSTRACT

An apparatus for checking the quality of rod-shaped, cylindrical objects, especially cigarettes, that are fed from a funnel-shaped storage container to a plurality of essentially parallel chutes, each of which has associated therewith at least one checking device and a subsequently disposed ejection mechanism for axially ejecting a defective object. In order to operate at high speeed with the least possible expense for construction and control, the essentially vertically disposed chutes, each of which has a width that is only slightly greater than the diameter of the rod-shaped objects, have at least their lower portion provided with a zig-zagged course that has at least one bend. A first slide mechanism is disposed below the chutes. This slide mechanism is provided with openings, each designed to receive a respective one of the rod-shaped objects, with the number of such openings corresponding to the number of chutes.

12 Claims, 6 Drawing Figures

APPARATUS FOR CHECKING THE QUALITY OF ROD-SHAPED, CYLINDRICAL OBJECTS

BACKGROUND OF THE INVENTION

The present invention relates to an apparatus for checking or inspecting the quality of rod-shaped, cylindrical objects, especially cigarettes, that are fed from a funnel-shaped storage container to a plurality of essentially parallel chutes, each of which has associated therewith at least one checking or inspecting device and a subsequently disposed ejection mechanism for axially ejecting a defective one of the rod-shaped objects.

In order to package cigarettes that have been produced in a cigarette manufacturing machine, and have possibly been provided with a filter, the cigarettes are supplied to the hopper or funnel of a cigarette-packaging machine, either continuously via conveyer-belt systems, or in batches via so-called trays. A plurality of parallel and essentially vertical chutes are provided on the underside of this hopper, which at the same time serves as a temporary storage means. The cigarettes enter the chutes from above, with the cigarettes being separated with the aid of these chutes. Those cigarettes which exit at a given time from the lower end of the chutes form a layer. A plurality of such layers are disposed one above the other, in this way forming a so-called cigarette block that is subsequently packaged to form a pack of cigarettes. The number of chutes that are correlated essentially corresponds to the number of cigarettes that form one of the layers of the cigarette block.

Since defects or damage can occur not only during the manufacture of the cigarettes but also during their transport to the end of the chutes, it is known to check or inspect not only the number of cigarettes that are combined to form a cigarette block, but also their quality, prior to the beginning of the packaging process. However, this does not prevent cigarettes from being missing, or that defective cigarettes are packaged. Nevertheless, this known checking process assures that after termination of the packaging process, packs of cigarettes having defective or missing cigarettes are separated out. A cigarette is considered defective if, among other things, it is crooked or otherwise deformed, is not completely filled with tobacco, or if the filter is missing or incorrectly placed on the cigarette.

Since with this known process a large number of satisfactory cigarettes, including the packaging material that is used, are sorted out, various proposals have been made for sorting out defective cigarettes prior to the formation of the cigarette blocks. For example, it is known to supply the cigarettes, after they leave the hopper, to the grooves of a drum that rotates in stages. The drum introduces the cigarettes one after the other into at least one checking device, and cooperates with an ejection device in which the defective cigarettes are sorted out, for example with the aid of an air jet that can be turned on in a controlled manner. It is also known to dispose a small or revolving member in each storage chute; each member is driven by a stepping motor and, after carrying out the quality check, transports the cigarettes that have entered the recesses thereof either into the lower portion of the chute, or into an ejection device in which the defective cigarettes are ejected in the axial direction.

These heretofore known constructions have the drawback that they are structurally complicated and expensive, and involve the danger that as a result of the rotating drums and revolving members, damages can occur to the cigarettes due to the high operating speed of the packaging machine. In addition, the control mechanism is complicated and expensive.

It is an object of the present invention to provide an apparatus of the aforementioned general type for checking rod-shaped, cylindrical objects, especially cigarettes, which apparatus, at low construction and control expense, and also with regard to the high operating speed, provides a reliable checking which, like the ejection of defective ones of the objects, takes place prior to the further processing, in particular the formation of cigarette blocks, so that only those objects which are really defective are sorted out, and a loss of packaging material is avoided.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
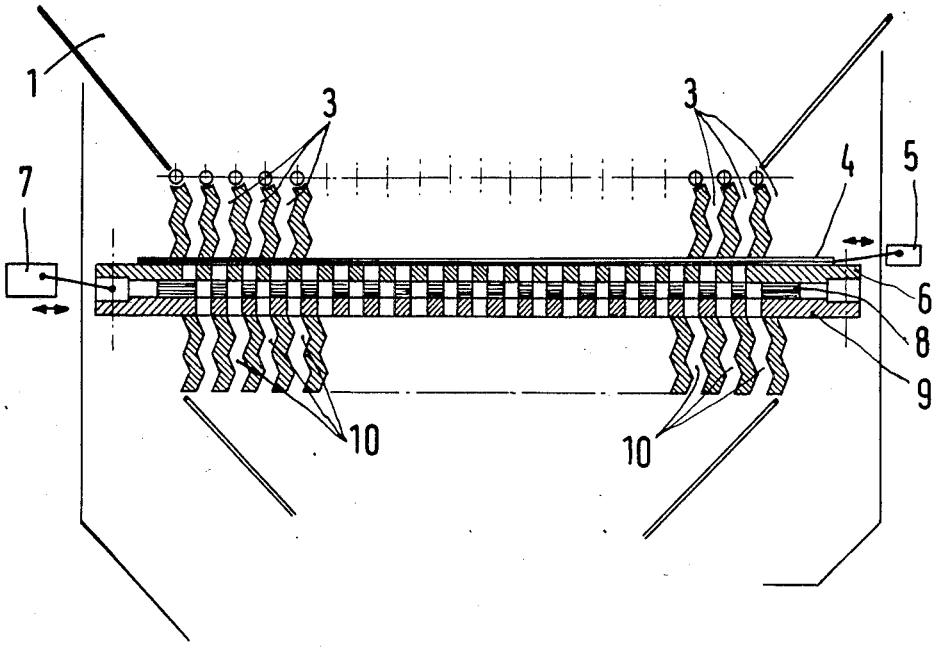
FIG. 1 shows a funnel-shaped storage container that is provided with one exemplary embodiment of the inventive apparatus.

The apparatus of the present invention is characterized primarily by: essentially vertically disposed ones of the chutes, each of which has a width that is only slightly greater than the diameter of the rod-shaped objects, with at least the lower portion of each chute being provided with a zig-zagged course that has at least one bend; a first slide mechanism disposed below the chutes; this slide mechanism is provided with openings, each designed to receive a respective one of the rod-shaped objects, with a number of openings corresponding to the number of chutes; means for shifting the first slide mechanism, in a controlled manner, transverse to the chutes over a distance that corresponds to at least to the width of the chutes; a fixed carrier disposed below the first slide mechanism; the carrier is provided with support members that are disposed below the chutes, with respective openings, each designed to receive a respective one of the rod-shaped objects, being disposed between the support members; a given one of the ejection mechanisms is associated with each of the openings of the carrier, with each ejection mechanism being actuatable as a function of the results of the at least one checking device of that same chute, with the checking devices being disposed above the carrier and a second slide mechanism disposed below the carrier, with this second slide mechanism being embodied in conformity with the first slide mechanism, and having a possibility of movement but corresponds to that of the first slide mechanism.

With the inventive apparatus, after the cigarettes located in the funnel-shaped storage container have been separated out by entering the chutes, each chute is checked to see whether the cigarettes are completely filled with tobacco and/or are provided with a filter. The zig-zagged course of the essentially vertical chutes already previously assures that crooked cigarettes, cigarettes in which the filters have been incorrectly placed, and cigarettes that are too flat are segregated. Defective cigarettes of this type jam in the zig-zagged chutes, so that they don't even get as far as the checking devices. The zig-zagged course of the chutes also prevents cigarettes that fall down in the chute after a build-up from tilting out of their intended horizontal position, i.e. these cigarettes cannot assume a vertical position.

Since an ejection mechanism is associated with each of the openings in the fixed carrier, and the first slide mechanism, with a cyclically recurring movement, supplies a respective cigarette from each chute to the carrier, sufficient time is available to eject via an axial displacement those cigarettes that have previously been identified as being defective. Subsequently, those cigarettes which have been determined to be in order fall downwardly out of the carrier through the openings of the second slide mechanism as soon as the latter is shifted. This second slide mechanism at the same time serves as a support for the cigarettes when they are disposed in the openings of the carrier. Since both the checking devices and the ejection mechanisms are stationary, the inventive apparatus merely requires a simple control of the movements of the two slide mechanisms, and an actuation of the ejection mechanisms in conformity with the respective results of the checking devices.

Pursuant to a further feature of the present invention, the checking devices may be respectively disposed in the region of the lower most rod-shaped objects in the chute.

Pursuant to one preferred embodiment of the present invention, it is proposed that a flat or plate-like auxiliary slide mechanism, which has openings that correspond to the diameter of the rod-shaped objects, be disposed between the lower end of the chutes and the first slide mechanism; this auxiliary slide mechanism can be shifted slightly below the chutes, with the chute width that is left free by the shifted auxiliary slide mechanism being slightly less than the diameter of the rod-shaped objects. The auxiliary slide mechanism can be shifted together with the first slide mechanism, so that the auxiliary slide mechanism wedges or restrains those objects that are located above the first slide mechanism. As a result, the checked object is held securely in place and hence is protected from damage by the first slide mechanism, which is also moving but is shifted over a greater distance. In place of the simultaneous shifting of the auxiliary slide mechanism, the latter can also be shifted shortly before the first auxiliary mechanism is shifted, and can prevent rod-shaped objects from falling into the openings of the first slide mechanism at the beginning of the shifting movement of the latter. This prevents the cigarettes from entering the first slide mechanism and becoming damaged when, after a, for example, crooked cigarette has become jammed in the chute and has been removed, the cigarettes located thereabove fall down, which involves the danger that these cigarettes that are falling down could reach the first slide mechanism just as the latter is being shifted, which would crush the cigarettes. However, if the auxiliary slide mechanism is shifted shortly before the first slide mechanism is shifted, the cigarettes that are falling down are restrained, thus preventing the cigarettes from falling through into the opening of the first slide mechanism. Furthermore, the slight shifting of the auxiliary slide mechanism also prevents the cigarettes that are falling down from being crushed between the auxiliary slide mechanism and the wall of the chute if the cigarettes fall down at the wrong point in time, namely when the auxiliary slide mechanism is being shifted. In such a situation, the cigarette that has fallen down is merely wedged between the slightly shifted auxiliary slide mechanism and the wall of the chute without damaging the cigarette. Shifting the auxiliary slide mechanism shortly prior to shifting the first slide mechanism furthermore has the effect, during a proper operating sequence, of protecting those cigarettes that are disposed above the first slide mechanism from damage due to movement of the latter. This corresponds to the situation where the auxiliary slide mechanism was shifted together with the first slide mechanism.

Pursuant to a modified embodiment of the auxiliary slide mechanism, and pursuant to a further feature of the present invention, it is proposed that when a defective object becomes jammed in a chute, and after the chute has emptied below the jammed object, the auxiliary slide mechanism be shiftable completely below the chute, thus blocking the furtherest supply of objects from the chute. This proves to be advantageous when a defective object is jammed in the chute and is subsequently removed by hand or mechanically. The reason is that then, as previously mentioned, there exists the danger that the objects which would slide down in the chute would be wedged at an unfavorable point in time either by the auxiliary slide mechanism or by the first slide mechanism, and in particular would be jammed when the obJects that are subsequently sliding down pass into the path of movement of the auxiliary slide mechanism or the first slide mechanism as the latter close. However, due to the fact that pursuant to this further development of the present invention of the auxiliary slide mechanism in this case blocks off the jammed chute, a wedging of objects that subsequently slide down can be prevented.

Pursuant to a further feature of the present invention, the auxiliary slide mechanism can comprise a number of individual auxiliary slide mechanisms that can be actuated individually; the number of these individual auxiliary slide mechanisms corresponds to the number of chutes. However, since this would make the cost and complexity of control quite high, it is furthermore proposed that several individual auxiliary slide mechanisms be respectively combined to form a plate-like group having openings, and preferably be combined to form groups that each have four individual auxiliary slide mechanisms; within these groups, the individual auxiliary slide mechanisms that belong to that group are actuated in common, while the groups themselves can be actuated individually, i e. independently, of one another. By combining individual auxiliary slide mechanisms to form plate-like groups, the expense for control is reduced considerably relative to totally individual auxiliary slide mechanisms without thereby adversely affecting the function. For example, combining four individually auxiliary slide mechanisms into a group is sufficient for a practical application.

Triggering the shifting of the auxiliary slide mechanism can be effected by the checking device which, if the absence of an object is detected, blocks the chute via the auxiliary slide mechanism. After the problem has been eliminated, the closed auxiliary slide mechanism is then retracted, so that the normal operating procedure can continue.

Pursuant to a preferred embodiment of the present invention, fixed storage chutes are disposed below the openings of the carrier; the filling state of these storage chutes is monitored by a light barrier unit. The cigarettes are withdrawn from these storage chutes to form the cigarette blocks. These storage chutes are also inventively embodied with a zig-zagged course in order to avoid tilting of the cigarettes as they fall down.

Further advantageous features and advantages of the present invention will be described in detail subsequently.

DESCRIPTION OF PREFERRED EMBODIMENTS

Referring now to the drawings in detail, the inventive apparatus for checking or inspecting rod-shaped, cylindrical objects is illustrated, by way of example, in connection with a funnel-shaped storage container 1 of a cigarette-packaging machine. The inventive apparatus is also suitable for other rod-shaped and cylindrical articles, such as cigarillos or rod-shaped filters. A plurality of approximately vertical chutes 3 are provided at the bottom end of the storage container 1. Each chute 3 has a width that is only slightly greater than the diameter of the cigarettes Z. Each chute 3 also follows a zig-zagged course having at least one band, so that the cigarettes Z can only fall downwardly in the chutes 3 if they are disposed horizontally.

Disposed below the chutes 3 is a flat or platelike auxiliary slide mechanism 4 that has a number of openings 4*a*, with the number of these openings corresponding to the number of chutes 3. Each of the openings 4*a* is larger than the diameter of the cigarettes Z. In the starting position illustrated in FIG. 2, the openings 4*a* are disposed below the chutes 3, which are opened toward the bottom. The auxiliary slide mechanism 4 can be shifted slightly in the horizontal direction via a drive mechanism 5, as indicated by the double arrow in FIG. 1.

Disposed below the auxilary slide mechanism 4 is a slide mechanism 6 that is horizontally displaceable by a drive mechanism 7, as indicated by the double arrow in FIG. 1. This first slide mechanism 6 has a number of openings 6*a*, each for a cigarette Z, with the number of such openings corresponding to the number of chutes 3.

Figure 2:
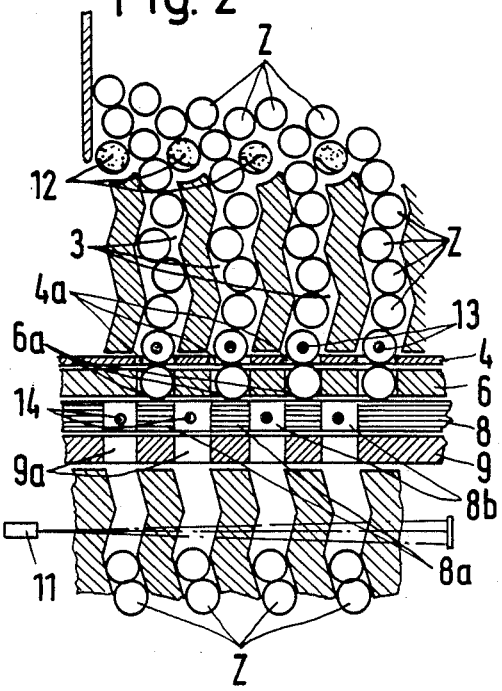
FIG. 2 is an enlarged view of a group of chutes, with the components of the inventive apparatus being in the starting position.
Figure 4:
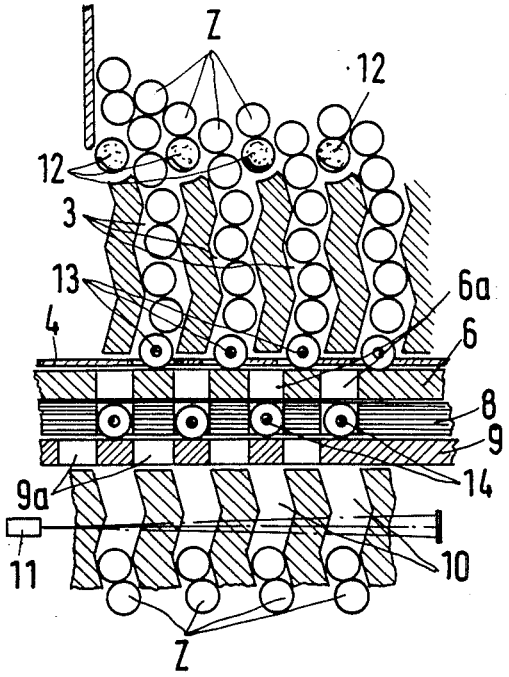
FIG. 4 is a further view of the chutes of FIGS. 2 and 3 after actuation of the first and second slide mechanisms.

In the illustrated embodiment, displacement or shifting of the slide mechanism 6 is effected over a distance corresponding to at least the width of the chutes, as can be seen by comparing FIGS. 2 and 4.

In the starting position of FIG. 2, the cigarettes Z that are located in the openings 6*a* are respectively disposed on a support member 8*a* of a carrier 8 that is fixedly disposed below the first slide mechanism 6. Between the support members 8*a* disposed below the chutes 3, this carrier 8 is also provided with respective openings 8*b*, each for a cigarette Z. Finally, a second slide mechanism 9 is disposed below the carrier 8. The second slide mechanism 9 is embodied and is displaceable in the same manner as is the first slide mechanism 6, and is provided with openings 9*a*.

Stationary storage chutes 10 are disposed directly below the second slide mechanism 9. These storage chutes 10 are respectively offset to the side relative to the chutes 3. These storage chutes 10 also have a zigzagged course, and their condition of filling is monitored by a light barrier unit 11.

From the storage container 1, the cigarettes Z pass into the individual chutes 3. Rotating or vibrating rods 12 disposed above the walls of the chutes 3 ensure that the cigarettes do not form bridges above the chute inlets. As shown in FIG. 2, the chutes 3 are filled with cigarettes Z. Since in the starting position the openings 4*a* of the auxiliary slide mechanism 4, and the opening 6*a* of the first slide mechanism 6, are disposed exactly below the chutes 3, a cigarette Z passes out of each chute 3 onto the support members 8*a* of the fixed carrier 8. A further cigarette Z located in the discharge area of the chutes 3, where a respective checking or inspection apparatus 13 is also disposed, possibly on both sides. The apparatus 13 check whether these cigarettes in the discharge area of the chutes 3 are completely filled with tobacco and/or are provided with a filter.

Figure 3:
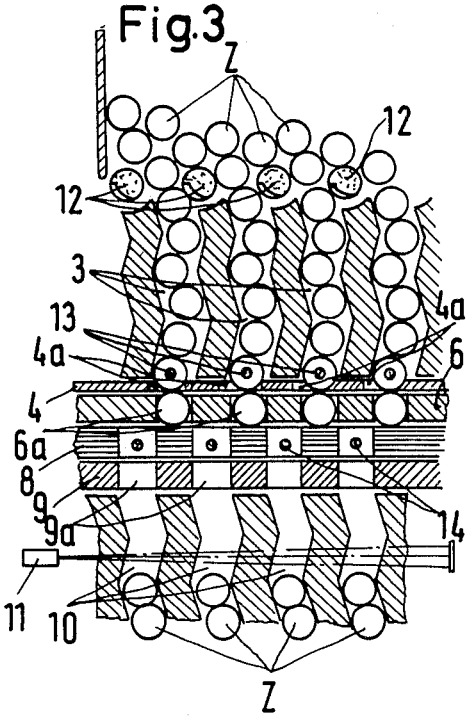
FIG. 3 is an enlarged view of a group of chutes during the checking process, with the auxiliary slide mechanism being shifted to the left.

Shortly before the slide mechanism 6 is shifted, the auxiliary slide mechanism 4 is shifted slightly to the left, as shown in FIG. 3, so that during the subsequent movement of the first slide mechanism 6 to the left, the checked cigarettes Z are held firmly in place, and are hence protected against damage from the moving slide mechanism 6. This slight movement of the auxiliary slide mechanism 4 to the left also serves to prevent cigarettes Z that have fallen down into the chutes 3 after a jam has been cleared from passing into the opening 6*a* of the first slide mechanism 6 at the wrong point in time and getting crushed. Instead, the cigarettes Z that have falled down are trapped or restrained by the auxiliary slide mechanism 4 The shift or displacement path of the auxiliary slide mechanism 4 suffices to prevent the cigarettes Z from falling through into the opening 6*a*. However, this displacement path is small enough in order to prevent damage to the cigarettes Z that have fallen down in the event that the cigarettes fall down at the wrong period of time while the auxiliary slide mechanism 4 is moving to the left, so that the cigarettes Z between the auxiliary slide mechanism 4 and the wall of the chute 3 can be wedged in. In order to protect the cigarettes Z located above the first slide mechanism 6 from dammage during shifting of the latter, the auxiliary slide mechanism 4 can be shifted at the same time as the first slide mechanism 6, as long as the latter covers a greater displacement distance than does the auxiliary slide mechanism 4. The auxiliary slide mechanism 4 must, at the latest, be retracted along with the first slide mechanism 6.

The cigarettes Z that are located in the openings 6*a* of the slide mechanism 6, and which have already been checked prior to the last checking process to be carried out, pass via the displacement of the slide mechanism 6 to the left over the openings 8*b* of the carrier 8, with the bottom side of these openings being closed off by the second slide mechanism 9, as shown in FIG. 4. In this way, the checked cigarettes Z remain in the openings 8*b* of the carrier 8, as shown in FIG. 4.

Ejection mechanisms 14 are disposed in the region of the openings 8*b* of the carrier 8. These ejection mechanisms 14 are actuated as a function of the result of the associated checking apparatus 13, and, of course, are actuated with the appropriate time lag. With the aid of these ejection mechanisms 14, those cigarettes Z that have been determined to be defective are ejected in the axial direction, for example with the aid of a push rod or an air jet.

Figure 5:
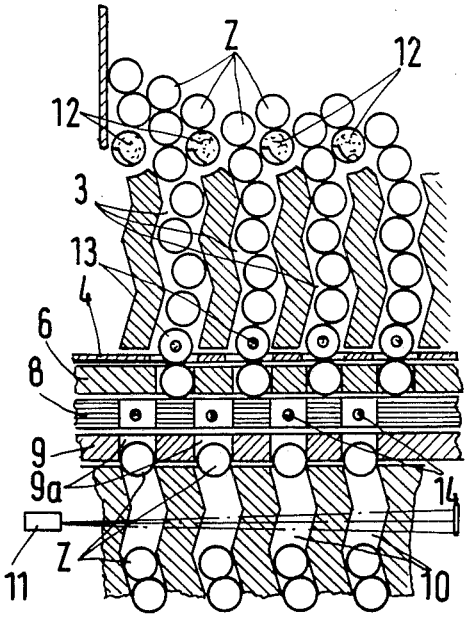
FIG. 5 is yet another view of the group of chutes after return of the first and second slide mechanisms, as well as of the additional slide mechanism, into the starting position.

Those cigarettes Z that have been found to be in order, i.e. correct, are released by a movement of the second slide mechanism 9 from the position illustrated in FIG. 4 into that illustrated in FIG. 5; these cigarettes Z then fall through the openings 9*a* of the slide mechanism 9 into the storage chutes 10. From the latter, the cigarettes are withdrawn to form cigarette blocks. At the same time that the slide mechanism 9 is moved, the slide mechanism 6 and the auxiliary slide mechanism 4 are returned to the starting position. The condition of filling of the storage chutes 10 is monitored by the light barrier unit 11, so that the drive mechanisms 5 and 7 are turned off when the filling height in the storage chutes 10 exceeds the level monitored by the unit 11.

Via the aforementioned repetitive process, all of the cigarettes Z are checked or inspected. Only those cigarettes that are determined to be defective are separated out, either within the chutes 3 or in the region of the carrier 8. Cigarettes Z that have become jamed in the chutes 3 are removed manually or mechanically. By storing the checked cigarettes in the storage chutes 10, and possibly an appropriately larger number of these storage chutes 10, there is assured that even if problems occur in one of the chutes 3 a sufficient number of cigarettes Z is always available for forming the cigarette blocks.

Figure 6:
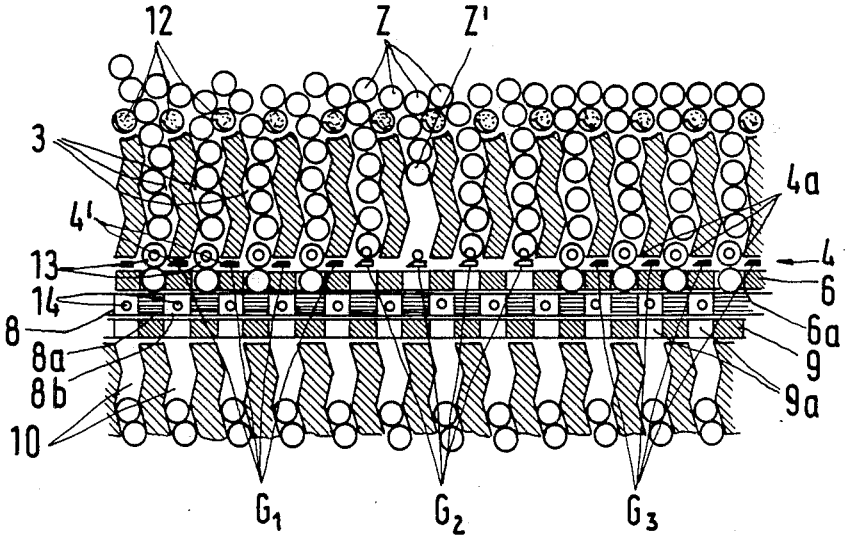
FIG. 6 is an enlarged view of a group of chutes, also in the starting position of the components of the apparatus, but with a modified embodiment of the auxiliary slide mechanism.

In the embodiment illustrated in FIG. 6, the auxiliary slide mechanism 4 is developed further. This further development of the auxiliary slide mechanism 4 is of particular advantage if, as previously mentioned, an overall disruption of the apparatus is to be prevented when a defective cigarette Z′ becomes jammed in one of the chutes 3. In such a situation, the cigarette Z′ that has become jammed in the chute 3 is removed by hand or mechanically. However, since in the meantime that portion of the chute 3 below the jammed cigarette Z′ has been emptied, the cigarettes Z disposed thereabove slide down into the chute 3 after the jammed cigarette Z′ has been removed. In so doing, the cigarette Z that subsequently slide down can reach the first slide mechanism 6 at an unfavorable point in time just when the first slide mechanism 6 is moving toward the left, so that the cigarette Z that is subsequently sliding down becomes jammed at that location. This causes a disruption, and causes the entire apparatus to be shut down.

To overcome this problem, pursuant to the present invention the auxiliary slide mechanism 4 is shifted below the chute 3, hence blocking the further supply of cigarettes Z, when, upon jamming of a defective cigarette Z′ in one of the chutes 3, this chute 3 becomes emptied below the jammed cigarette Z′. By shifting the auxiliary slide mechanism 4, and hence blocking the chute 3, a further jamming at the location of the slide mechanism 6 is avoided after the jammed cigarette Z′ has been removed from the chute 3.

In the embodiment illustrated in FIG. 6, the auxiliary slide mechanism 4 comprises a plurality of plate-like groups G1, G2, G3, each of which comprises four individual auxiliary slide mechanisms 4′, between each of which a respective opening 4*a* is provided. The individual auxiliary slide mechanisms 4′ that are combined to form a given one of the groups G1, G2, G3 are actuated in common, whereas the individual groups G1, G2, G3 as such can be actuated individually of one another. Thus, when a defective cigarette Z′ becomes jammed, the appropriate group of individual auxiliary slide mechanisms 4′ is actuated. In the illustrated embodiment, this is the central group C2. After elimination of the problem, i.e. the jammed cigarette Z′, the closed group G2 is again retracted, so that the normal cigarettes Z′ that have in the meantime slid down can again be checked in the normal manner.

It is to be understood that instead of grouping individual auxiliary slide mechanisms 4′ together into the groups G1, G2, G3, each shaft 3 could be provided with a separate individual auxiliary slide mechanism 4′. However, in such a case the expense is much greater. The grouping of a plurality of individual auxiliary slide mechanisms 4′ into the groups G1, G2, G3, preferably with four individual auxiliary slide mechanisms in each group, is sufficient for a practical application.

The triggering of the shifting of the auxiliary slide mechanism 4 can be effected by the checking apparatus 13. When the latter determines that no cigarette Z is present for checking, the cause for this must be that a defective cigarette Z′ has become jammed in the shaft 3. In such a case, the checking apparatus 13 actuates the auxiliary slide mechanism 4 and shifts the appropriate group, in this case G2, to the left, thus blocking the further supply of cigarettes into the chutes 3 that are associated with the group G2.

The present invention is, of course, in no way restricted to the specific disclosure of the specification and drawings, but also encompasses any modifications within the scope of the appended claims.

What we claim is:

1. An apparatus for checking the quality of rod-shaped, cylindrical objects that are fed from a storage container to a plurality of essentially parallel chutes, each of which has associated therewith at least one checking device and a subsequently disposed ejection mechanism for ejecting defective ones of said rod-shaped objects; said apparatus comprising:

essentially vertically disposed ones of said chutes, each of which has a width that is only slightly greater than the diameter of said rod-shaped objects, with at least that portion of each of said chutes remote from said storage container being provided with a zig-zagged course that has at least one bend;

a first slide mechanism disposed on that side of said chutes remote from said storage container; said first slide mechanism is provided with openings, each designed to receive a respective one of said rod-shaped objects, with the number of said openings corresponding to the number of said chutes;

means for shifting said first slide mechanism, in a controlled manner, transverse to said chutes over a distance that corresponds at least to said width of said chutes;

a fixed carrier disposed on that side of said first slide mechanism remote from said chutes; said carrier is provided with support members that are disposed adjacent to said first slide mechanism, with respective openings, each designed to receive a respective one of said rod-shaped objects, being disposed between said support members; a given one of said ejection mechanisms is associated with each of said openings of said carrier, with each ejection mechanism being actuatable as a function of the result of said at least one checking device of the associated chute, with said checking devices being disposed on that side of said first slide mechanism remote from said carrier; and a second slide mechanism disposed on that side of said carrier remote from said first slide mechanism, with said second slide mechanism being embodied in conformity with said first slide mechanism, and having a possibility of movement that corresponds to that of said first slide mechanism.

2. An apparatus according to claim 1, in which said checking devices are disposed in that region of said chutes most remote from said storage container.

3. An apparatus according to claim 1, which includes a flat auxiliary slide mechanism that is disposed between said chutes and said first slide mechanism; said auxiliary slide mechanism is provided with openings that correspond to the diameter of said rod-shaped objects; means are provided for shifting said auxiliary slide mechanism, and the latter can be shifted slightly below said chutes, with the chute width that is left free by the shifted auxiliary slide mechanism being slightly less than the diameter of said rod-shaped objects.

4. An apparatus according to claim 3, in which said auxiliary slide mechanism is shifted together with said first slide mechanism, but is shifted over a shorter distance than the latter in order to restrain those rod-shaped objects that are disposed on that side of said first slide mechanism remote from said carrier.

5. An apparatus according to claim 3, in which shifting of said auxiliary slide mechanism is effected shortly prior to shifting of said first slide mechanism, thus preventing rod-shaped objects from falling down into said openings of said first slide mechanism as the latter begins to shift.

6. An apparatus according to claim 3, in which a return shifting of said auxiliary slide mechanism is effected no later than the return shifting of said first slide mechanism.

7. An apparatus according to claim 3, in which, when a defective object has become jammed in one of said chutes, and the latter has been emptied of rod-shaped objects that were disposed between said jammed object and said first slide mechanism, said auxiliary slide mechanism is shiftable to cover said chute, thus blocking the further supply of rod-shaped objects from said chute.

8. An apparatus according to claim 7, in which said auxiliary slide mechanism comprises a plurality of individual auxiliary slide mechanisms; the latter are individually actuatable, with the number thereof corresponding to the number of said chutes.

9. An apparatus according to claim 8, in which said individual auxiliary slide mechanisms are combined to form several plate-like groups, each of which is provided with said auxiliary slide mechanism openings; the individual auxiliary slide mechanisms of a given group are actuatable in common, with the groups themselves being actuatable independently of one another.

10. An apparatus according to claim 7, in which triggering of shifting of said auxiliary slide mechanism is effected by one of said checking devices, which, when it has detected the absence of a rod-shaped object in its chute, triggers said auxiliary slide mechanism to block said chute.

11. An apparatus according to claim 1, which includes stationary storage chutes that are disposed on that side of said carrier remote from said first slide mechanism for receiving rod-shaped objects from said openings of said carrier; and which includes light barrier unit means for monitoring the filling state of said storage chutes.

12. An apparatus according to claim 11, in which said storage chutes are also provided with a zig-zagged course.

* * * * *